US011548020B2

(12) United States Patent
Pearl, II et al.

(10) Patent No.: US 11,548,020 B2
(45) Date of Patent: Jan. 10, 2023

(54) RETAINING BRACKET FOR APPLICATOR ROD, FLUID SPRAY APPLICATION SYSTEM INCLUDING THE SAME, AND METHOD OF APPLYING A FLUID TO A TARGET OBJECT

(71) Applicant: Uniweld Products, Inc., Fort Lauderdale, FL (US)

(72) Inventors: David S. Pearl, II, Fort Lauderdale, FL (US); Dragan Bukur, Fort Lauderdale, FL (US); Robert Lee Latham, Tamarac, FL (US)

(73) Assignee: Uniweld Products, Inc., Fort Lauderdale, FL (US)

( * ) Notice: Subject to any disclaimer, the term of this patent is extended or adjusted under 35 U.S.C. 154(b) by 84 days.

(21) Appl. No.: 17/308,403

(22) Filed: May 5, 2021

(65) Prior Publication Data

US 2022/0355321 A1 Nov. 10, 2022

(51) Int. Cl.
*B05B 11/00* (2006.01)
*B08B 3/02* (2006.01)
*F28G 1/16* (2006.01)

(52) U.S. Cl.
CPC ..... *B05B 11/0008* (2013.01); *B08B 3/026* (2013.01); *F28G 1/166* (2013.01)

(58) Field of Classification Search
CPC ... B05B 11/0008; B05B 9/0426; B08B 3/026; F28G 1/166
USPC ..... 222/573, 174; 239/375–378, 526, 531, 239/532
See application file for complete search history.

(56) References Cited

U.S. PATENT DOCUMENTS 238,388 A * 3/1881 Heine ..... A61M 11/06 128/200.22
1,998,776 A * 4/1935 Collins ..... A61M 11/02 239/289
2,293,390 A * 8/1942 Hengesbach ..... A01C 23/042 239/318
2,548,487 A * 4/1951 Marchant ..... A01H 1/027 47/1.41
2,919,071 A * 12/1959 Dalton ..... A62C 31/28 239/525
3,716,195 A * 2/1973 Silva ..... B65D 83/203 D8/51
3,863,903 A * 2/1975 Brehmer ..... B05B 15/25 366/279

(Continued)

*Primary Examiner* — Donnell A Long
*Assistant Examiner* — Randall A Gruby
(74) *Attorney, Agent, or Firm* — Nields, Lemack & Frame, LLC

(57) ABSTRACT

Retaining bracket for a fluid spray delivery apparatus to ensure that an applicator rod remains properly attached to the apparatus and in fluid communication with the fluid even when subjected to a driving force. Also disclosed is a fluid application system or assembly, and a method of applying fluid using the same, the system or assembly including a source of fluid to be applied to a target object, a siphon gun assembly, an applicator rod, tubing for placing the applicator rod in fluid communication with the siphon gun assembly, and a retaining bracket that secures the tubing to the siphon gun assembly such that the tubing remains in place and does not disconnect from the siphon gun assembly when subjected to a driving force such as water under pressure.

2 Claims, 5 Drawing Sheets

(56) References Cited

U.S. PATENT DOCUMENTS 4,023,711 A * 5/1977 Sena ..... B05B 15/628 222/174
4,653,691 A * 3/1987 Grime ..... B05B 7/2454 239/311
4,928,856 A * 5/1990 White ..... B67D 3/0029 222/509
5,052,624 A * 10/1991 Boers ..... B08B 3/028 239/599
5,671,887 A * 9/1997 Iavarone ..... B05B 7/2445 111/7.1
5,769,279 A * 6/1998 Smrt ..... B65D 83/203 222/174
5,992,690 A 11/1999 Tracy
6,253,971 B1 * 7/2001 Cobb ..... B65D 83/303 222/402.1
6,412,671 B1 * 7/2002 Riley ..... B65D 83/303 222/402.1
6,557,815 B1 * 5/2003 Klein, II ..... B05B 7/2405 248/609
7,040,546 B2 * 5/2006 Horan ..... B05B 15/68 239/289
7,389,947 B2 * 6/2008 Denton ..... B05B 11/0089 222/402.1
8,944,348 B2 * 2/2015 Zhou ..... B05B 7/2424 222/401
9,440,249 B1 9/2016 Kane et al.
9,452,311 B1 * 9/2016 Kaczmarek ..... A63B 21/4033
9,561,516 B2 * 2/2017 Decker ..... A01M 7/0046
9,746,261 B2 8/2017 Seippel
10,480,875 B2 11/2019 Metropoulos
2004/0007633 A1 * 1/2004 Simmons ..... B05B 15/656 239/532
2005/0155972 A1 * 7/2005 Ray ..... B05B 7/2408 220/200
2006/0157629 A1 * 7/2006 Silverman ..... B65H 75/366 248/311.2
2016/0296980 A1 * 10/2016 Zheng ..... G02B 23/2484
2020/0149833 A1 5/2020 Dwight et al.

* cited by examiner

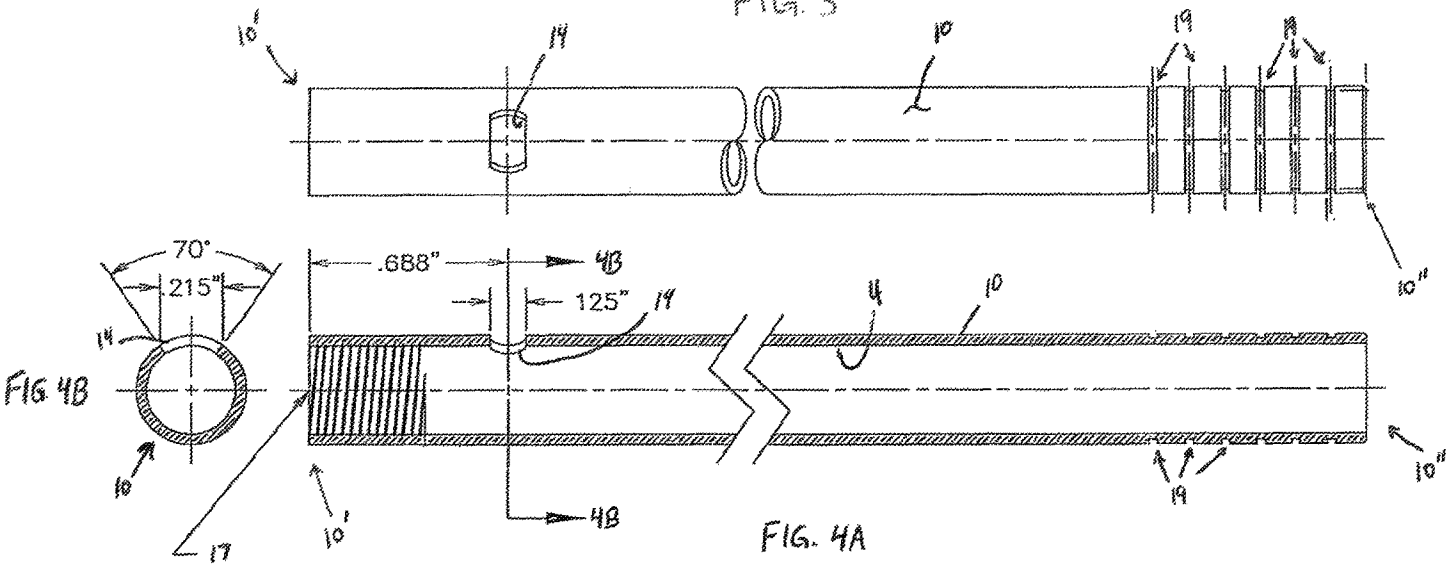
FIG. 3
FIG. 4A
FIG. 4B
.688"
.125"
.215"
70°
4B
10
10'
10"
11
14
17
18
19
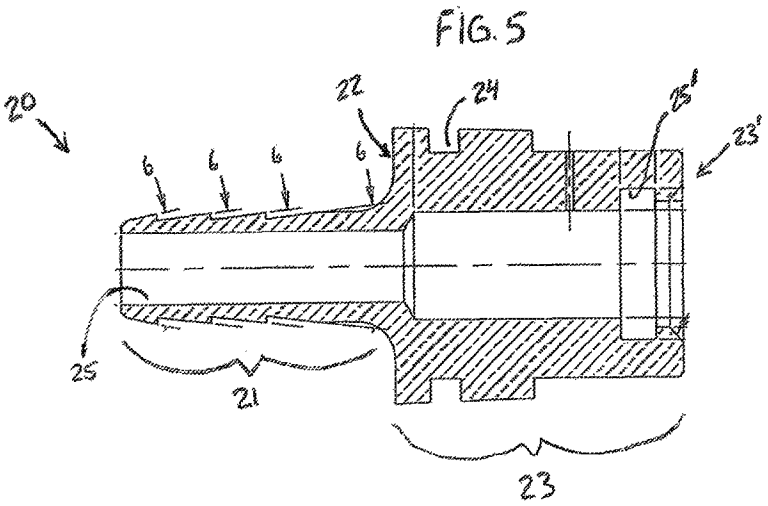
FIG. 5
20
21
22
23
23'
24
25

FIG. 6A
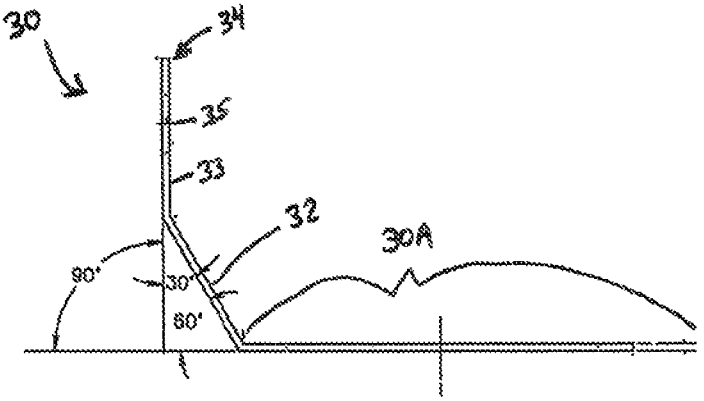
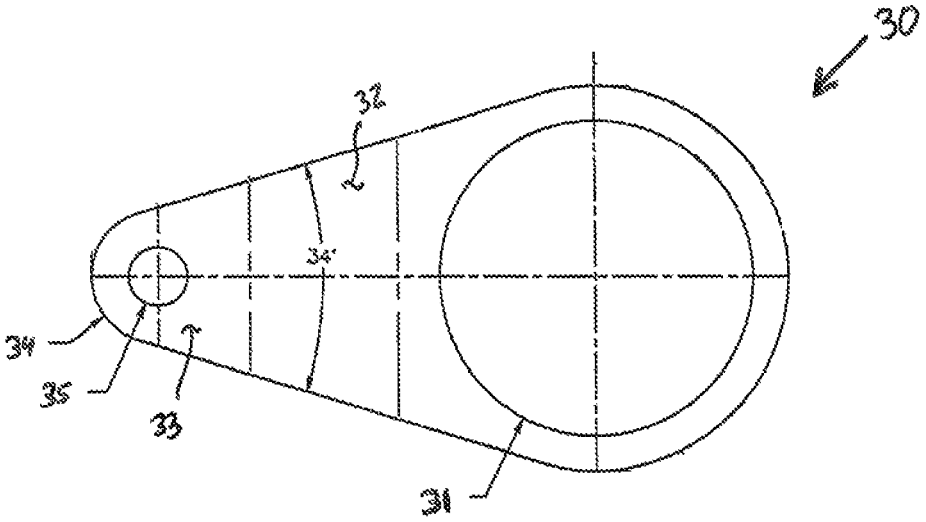
FIG. 6B

RETAINING BRACKET FOR APPLICATOR ROD, FLUID SPRAY APPLICATION SYSTEM INCLUDING THE SAME, AND METHOD OF APPLYING A FLUID TO A TARGET OBJECT

BACKGROUND

Mechanical air conditioning and refrigeration is accomplished by continuously circulating, evaporating, and condensing a fixed supply of refrigerant in a closed system. Charging or recharging an air conditioning or refrigeration system with refrigerant is done through the low side suction intake fitting with the use of manifold gauges and service hoses. Low-pressure vapor refrigerant is compressed and discharged from a compressor as a high temperature, high-pressure, "superheated" vapor or liquid. The high-pressure refrigerant flows to a condenser, where it is changed to a low temperature, high-pressure liquid. It then flows through a filter dryer to a thermal expansion valve or TXV. The TXV meters the correct amount of liquid refrigerant into an evaporator. As the TXV meters the refrigerant, the high-pressure liquid changes to a low pressure, low temperature, saturated liquid/vapor. This saturated liquid/vapor enters the evaporator and is changed to a low pressure, dry vapor. The low pressure, dry vapor is then returned to the compressor. The cycle then repeats.

Such apparatus typically includes heat transfer coils (e.g., condenser and evaporator coils), cooling fins, and other components, which may be exposed to conditions that cause dirt and debris to accumulate on their surfaces and in gaps between them. For example, debris stuck on or between fins will reduce the heat exchange efficiency of the fins, and will reduce air flow through gaps between fins, reducing the overall efficiency of the unit. Some or all of these components should be cleaned periodically to ensure optimal operating efficiency of the apparatus. However, some components are difficult to access from the exterior of the unit, and due to their inaccessibility, cleaning is difficult and often not done, or at least not done well.

Coil cleaning apparatus exists that attempts to address these problems, and includes spray units with applicator wands that apply, under pressure, a fluid or foam to the HVAC unit. Difficulties have arisen, however, in that the applicator wand can unexpectantly disengage from the spray unit when subject to the operating pressures of the unit, resulting in a potentially dangerous and messy situation.

Embodiments disclosed herein address this problem by providing an apparatus and method that efficiently and effectively enables the application of fluid, for example, under pressure, in hard-to-reach places such as heat exchange coils, fins, or other internal components of HVAC systems, while eliminating the possibility of the applicator dislodging or disconnecting from the apparatus.

These and other objects and advantages of the embodiments disclosed herein and advantageous features thereof will become apparent as the description proceeds below.

SUMMARY

Problems of the prior art have been addressed by the embodiments disclosed herein, which relate to a retaining bracket for a fluid spray delivery apparatus, the retaining bracket ensuring that the applicator rod or probe remains properly attached to the apparatus and in fluid communication with the fluid even when subjected to a driving force such as hydraulic pressure. Also disclosed is a fluid application system or assembly, including a source of fluid to be applied to a target object, a siphon gun assembly, an applicator rod, tubing for placing the applicator rod in fluid communication with the siphon gun assembly, and a retaining bracket that secures the tubing to the siphon gun assembly such that the tubing remains in place and does not disconnect from the siphon gun assembly when subjected to a driving force such as water under pressure. In certain embodiments, the assembly is a hand-held spraying assembly.

Also disclosed is a method of cleaning a target object, comprising securing with a retaining bracket a fluid applicator rod to a spray gun in fluid communication with source of cleaning fluid and a driving force such as pressurized water, and actuating the spray gun to cause a mixture of water and cleaning fluid, under pressure, to exit the applicator rod and impact the target object. In certain embodiments, the cleaning fluid may be a foam or may be capable of foaming once applied to the target object.

In some embodiments, the target object is an HVAC unit. In some embodiments, the target object is one or more coils of an HVAC (heating, ventilation and air conditioning) unit and/or debris that has formed in the spaces in between such coils, and/or is one or more heat exchange fins of the coils and/or spaces in between the fins. In certain embodiments, where in operation air flows into a first side of the HVAC unit and exits a second side spaced from the first side, the cleaning fluid may be applied to the first side, either from the outside towards the inside of the unit, or from the inside of the unit towards the outside (i.e., opposite to the direction of airflow during operation of the HVAC unit), or both.

Accordingly, in certain embodiments there is disclosed a fluid spray assembly, comprising a container having a container body and defining a volume for containing a fluid to be sprayed, the container having an opening defined by a container neck that in some embodiments extends axially from the container body, the opening being closable by a cap that secures to said container neck; a siphon gun assembly including said cap, said siphon gun assembly having a fluid passage for delivery of fluid contained in said container and configured to couple with a spray gun; an applicator rod in fluid communication with said fluid passage via a hose or the like and a connector coupling said hose to said siphon gun assembly; and a retaining bracket securing said hose to said siphon gun assembly, said retaining bracket having a first region comprising an opening configured to position about said container neck and a second region comprising a first leg having an aperture configured to receive said connector.

In some embodiments a method of cleaning a target object is disclosed, the method comprising securing with a retaining bracket a hose in fluid communication with a fluid applicator rod to a siphon gun assembly including a spray gun; placing the siphon gun assembly in fluid communication with a source of cleaning fluid and pressurized water; and actuating the spray gun to cause a mixture of the water and the cleaning fluid to exit the applicator rod and impact the target object.

These and other non-limiting aspects and/or objects of the disclosure are more particularly described below. For a better understanding of the embodiments disclosed herein, reference is made to the accompanying drawings and description forming a part of this disclosure.

BRIEF DESCRIPTION OF THE DRAWINGS

FIG. 3 is a top view of the distal region of an applicator rod in accordance with certain embodiments;

FIG. 4A is a cross-sectional view of the distal region of the applicator rod of FIG. 3;

FIG. 4B is a cross-sectional end view of applicator rod of FIG. 4A;

FIG. 5 is a cross-sectional view of a connector in accordance with certain embodiments;

FIG. 6A is a side view of a retaining bracket in accordance with certain embodiments;

FIG. 6B is a top view of a retaining bracket in accordance with certain embodiments;

DETAILED DESCRIPTION

Figure 1:
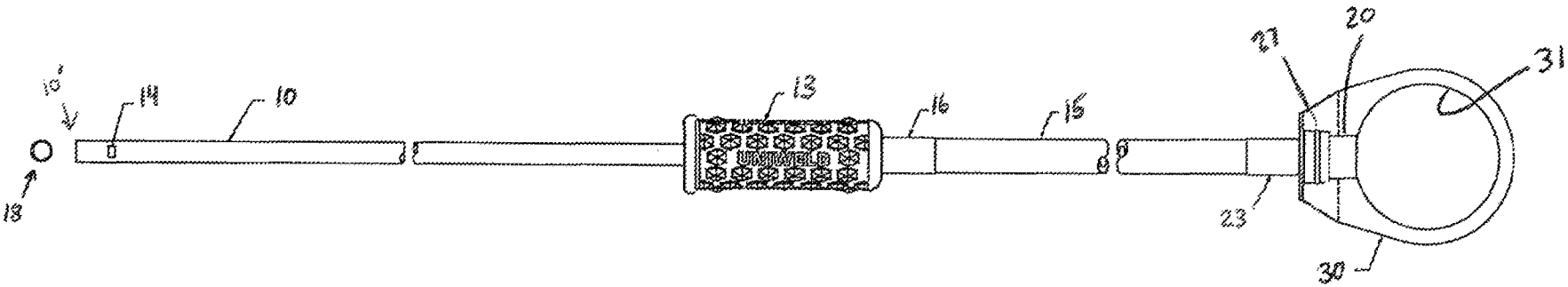
FIG. 1 is a top view of an applicator rod and retaining bracket assembly in accordance with certain embodiments.

A more complete understanding of the components, processes and apparatuses disclosed herein can be obtained by reference to the accompanying drawing. The figures are merely schematic representations based on convenience and the ease of demonstrating the present disclosure, and is, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawing, and are not intended to define or limit the scope of the disclosure. In the drawing and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

All ranges disclosed herein are inclusive of the recited endpoint and independently combinable (for example, the range of "from 2 inches to 10 inches" is inclusive of the endpoints, 2 inches and 10 inches, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression "from about 2 to about 4" also discloses the range "from 2 to 4."

It should be noted that many of the terms used herein are relative terms. For example, the terms "upper" and "lower" are relative to each other in location, i.e. an upper component is located at a higher elevation than a lower component, and should not be construed as requiring a particular orientation or location of the structure. As a further example, the terms "interior", "exterior", "inward", and "outward" are relative to a center, and should not be construed as requiring a particular orientation or location of the structure.

The terms "top" and "bottom" are relative to an absolute reference, i.e. the surface of the earth. Put another way, a top location is always located at a higher elevation than a bottom location, toward the surface of the earth.

The terms "horizontal" and "vertical" are used to indicate direction relative to an absolute reference, i.e. ground level. However, these terms should not be construed to require structures to be absolutely parallel or absolutely perpendicular to each other.

Turning now to FIGS. 1 and 2, there is shown an applicator rod, wand or probe 10 and a retaining bracket 30 in accordance with certain embodiments. The applicator rod 10 and retaining bracket 30 are particularly adapted for use with commercially available HVAC coil cleaning apparatus, such as spray coil cleaning apparatus that includes a siphon gun assembly that automatically mixes, in a mixing ratio set by the operator, water and a cleaner housed in a container. The siphon gun assembly may be conventional (see U.S. Pat. No. 9,440,249, the disclosure of which is hereby incorporated by reference), and may include a fluid passage that is smaller in diameter than the fluid passage of a spray gun coupled thereto, so as to increases the pressure of the fluid in that fluid passage. The applicator rod 10 may be an elongated cylindrical member and may include a grip or handle 13 to facilitate grasping of the applicator rod 10 by an operator. The location of the grip 13, if present, along the length of the applicator rod 10 is not particularly limited, and is preferably optimally spaced from the free end 10' of the applicator rod 10 a distance that facilitates easy maneuvering of the rod 10 by the operator. The outer surface of the grip 13 may be textured or knurled, such as is shown in FIG. 1, to enhance the grip of the operator.

In some embodiments the applicator rod 10 is a rigid elongated member, preferably in the form of a cylindrical shaft, having an axial internal bore 4 for the passage of fluid, and a nozzle opening 14 (FIG. 4B). As best seen in FIGS. 3 and 4A, the nozzle opening 14 may be positioned at or near the free end 10' of the applicator rod 10, preferably about 0.5 to 1.5 inches from the free end 10' (as measured from the center of the nozzle opening 14), more preferably about 0.666 to about 0.75 inches from the free end 10' (as measured from the center of the nozzle opening 14), most preferably 0.688 inches from the free end 10' (as measured from the center of the nozzle opening 14). In some embodiments, the nozzle opening 14 is positioned radially about the applicator rod 10 and occupies about 700 of the circumferential surface of the applicator rod 10 (see FIG. 4B), and extends axially along the rod 10 a distance of 0.125 inches. This enables spray to exit the nozzle opening 14 at about a 90° angle relative to the longitudinal axis of the applicator rod 10. In certain embodiments, the free end 10' of the applicator rod 10 may include internal threads 17 (FIG. 4A) configured to mate with external threads on a plug or end cap 18 (FIG. 1) to seal the distal end of the rod 10 in a water-tight manner. Other ways to seal the internal bore at the free end 10' may be used and are within the scope of the embodiments disclosed herein.

In some embodiments, the proximal end 10" of the applicator rod may include one or more (6 shown) spaced, circumferential indentations 19 (FIGS. 3 and 4A) that receive ferrule 16 as discussed in greater detail below. Suitable applicator rods 10 include those made of stainless steel, plastic, or other rigid material that can withstand the operating pressures (e.g., about 5-15 psi, preferably about 7-12 psi, most preferably about 10 psi) and can accommodate the nature of the fluid being applied. The length of the applicator rod 10 is not particularly limited, and preferably is sufficiently long to enable easy maneuverability of the assembly by the user. One suitable length is 40 inches. A stainless steel rod having an outside diameter of ⅜" has been found to be suitable.

In certain embodiments, a flexible elongated tube, hose, conduit or the like 15, preferably at one end 15' thereof, is coupled to the applicator rod 10 such as with a ferrule 16. The tube 15 has an internal bore 3 permitting fluid communication between opposite ends of the tube 15, and is in fluid communication with the internal bore 4 of the applicator rod 10 when the tube 15 and rod 10 are coupled together. The length of the flexible tube 15 is not particularly limited, and preferably is sufficiently long to enable easy maneuverability of the assembly by the user. One suitable length is 36 inches.

In some embodiments, the opposite end 15" of the flexible hose 15, spaced from end 15', is configured to receive a connector 20 (FIG. 5). The connector 20 includes a male end segment 21 that preferably includes one or more spaced external barbs 6 formed on its outer surface to facilitate its attachment to the internal bore 3 of the flexible tube 15. Thus, in certain embodiments the internal diameter of the internal bore 3 at the end 15" of the flexible hose 15 and the external diameter of the male end segment 21 are sized so that the male end segment 21 can be cooperatively received and secured in the internal bore 3 of the flexible tube 15, as shown in FIG. 1. A ferrule 23 or the like may be used to securely fasten the retaining bracket 20 and the flexible hose 15 such as by crimping. Those skilled in the art will appreciate that other fasteners can be used and are within the spirit and scope of the embodiments disclosed herein.

The male end segment 21 extends from a main body region 23 of the connector 20, transitioning to the main body region 23 at annular shoulder 22 that has an external diameter larger than the external diameter of the male end segment 21. In some embodiments, the main body 23 includes a circumferential groove 24 spaced from the shoulder 22 and configured to receive an O-ring 27 or the like to create a secondary fluid-tight seal and stabilizer in cap end 45'. In certain embodiments, the connector 20 has an internal bore 25 that extends through the connector 20 and is in fluid communication with the internal bore 3 of the hose 15 when the connector 20 is attached to the hose 15 in the assembled condition. In some embodiments, the diameter of the internal bore in the main body region 23 is larger than the internal diameter of the internal bore in the male end segment 21. For example, the diameter of the internal bore in the male end segment 21 may be 0.25 inches, and the diameter of the internal bore in the main body region 23 may be 0.375 inches. In some embodiments, a region 25' of the internal bore positioned near the free end 23' of the main body region 23 may have an even larger diameter, e.g., 0.525 inches, as shown in FIG. 5. This region 25' may receive an internal O-ring or the like (not shown) to create a fluid-tight seal when attached to the siphon gun assembly 45.

FIGS. 6A and 6B illustrate a retaining bracket 30 in accordance with certain embodiments. The retaining bracket 30 should be made of a rigid material capable of withstanding the forces it is subject to during use (e.g., 10 psi) of the fluid spray delivery apparatus without bending or breaking. Suitable materials include metal and certain plastics, such as polyolefins, with aluminum being particularly preferred. Aluminum having a thickness of 1/16" has been found to be particularly suitable.

Figure 2A:
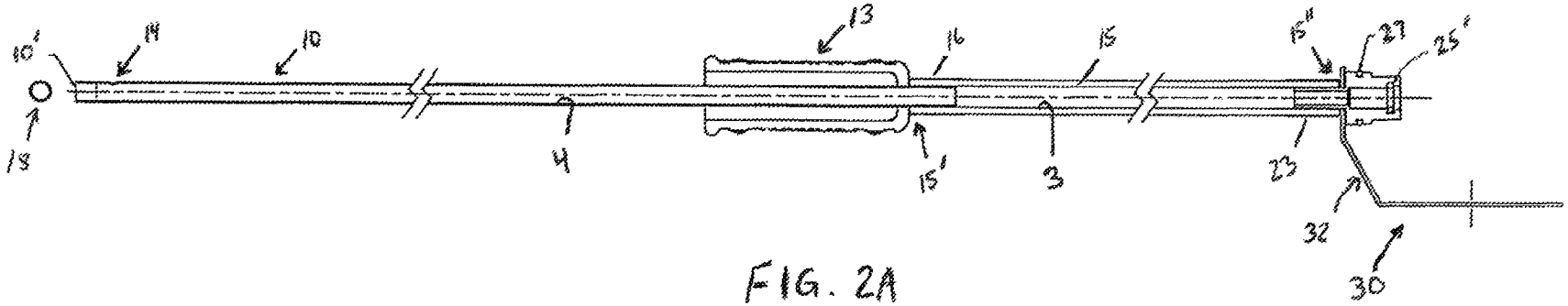
FIG. 2A is a cross-sectional view of the applicator rod and retaining bracket of FIG. 1.
Figure 2B:
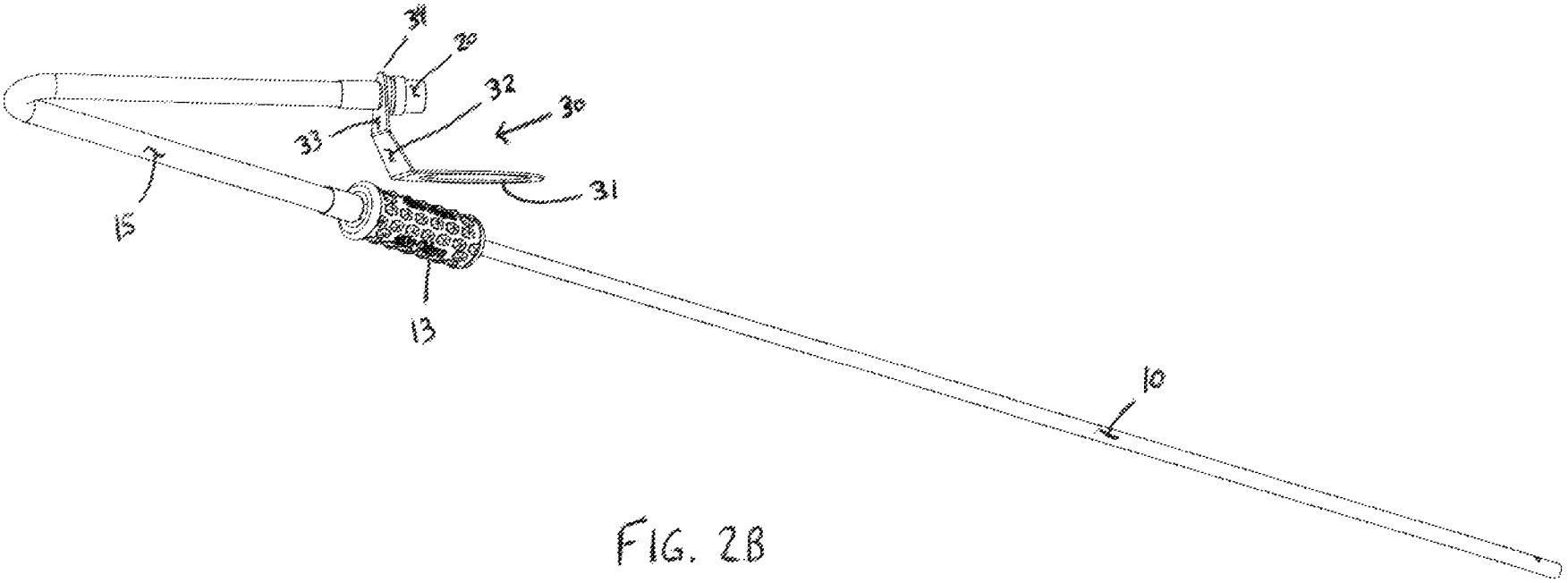
FIG. 2B is a perspective view of the applicator rod and retaining bracket of FIG. 1.
Figure 7A:
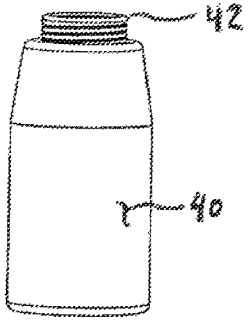
FIG. 7A is a perspective view of a container with an open neck in accordance with certain embodiments.

In certain embodiments, the retaining bracket 30 includes a first region 30A that includes an opening 31 having a diameter sufficient to receive or circumscribe the open neck 42 of a container 40 (FIG. 7A) for housing the fluid to be sprayed. In the embodiment shown, the neck 42 extends axially from the container main body that defines a volume for containing fluid. The retaining bracket 30 also has a second region that includes a first leg 32 and a second leg 33 terminating in a free end 34. Preferably the retaining bracket 30 is a unitary body. In some embodiments, the second leg 33 is perpendicular to the first region 30A, and thus the first leg 32 functions to provide a transition between the first region 30A and the second leg 33. Those skilled in the art will appreciate that more than one bent region could be used to effect that transition, or that the first leg 32 may be eliminated. In the embodiment shown, the first leg 32 is angled at about 60° relative to the first region 30A. In some embodiments, the second leg 33 includes an aperture 35 spaced from the free end of the second bent leg 33 and having a diameter effective to receive the male end segment 21 of the connector 20, as best seen in FIGS. 2A and 2B.

In some embodiments, to attach the retaining bracket 30 to the assembly, the male end segment 21 of the connector 15 is inserted in the aperture 35, and then the male end segment 21 is inserted into the internal bore 3 of the hose 15 and secured there, such as with ferrule 23. The retaining bracket 30 may be secured to the container 40 for holding fluid to be sprayed by removing the cap 41 on the container, inserting the opening 31 of retaining bracket 30 around the open neck 42 of the container 40, and then attaching the cap 41 on the container (typically a threaded connection), thereby securing the retaining bracket 30 in place about the outer circumference of the neck 42 of the container 40.

Figure 7B:
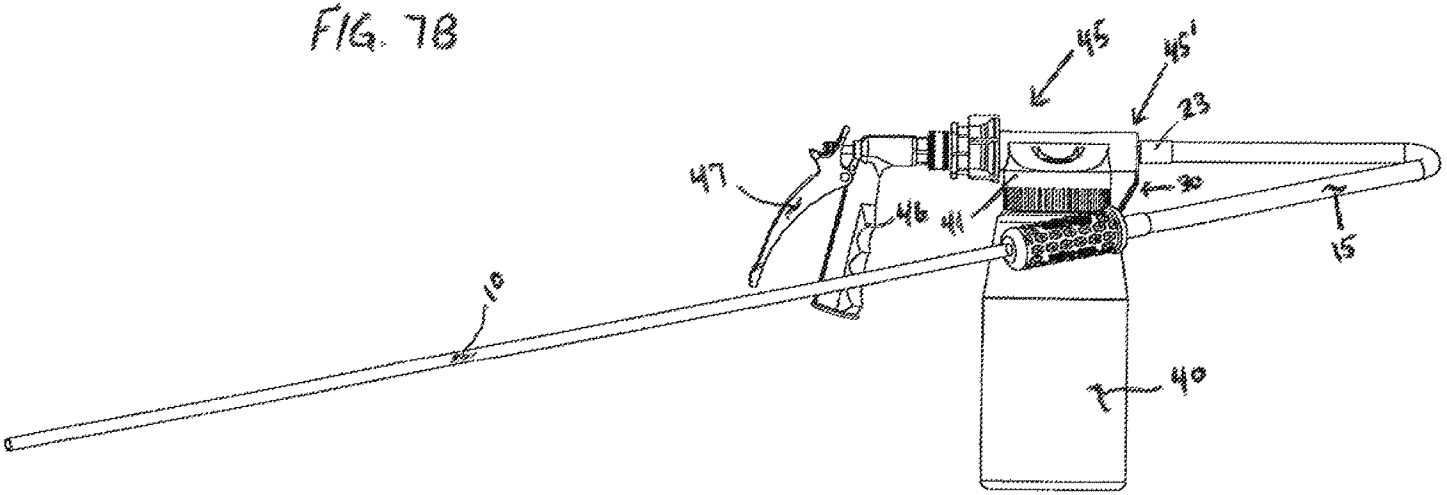
FIG. 7B is a perspective view of an assembled spray apparatus assembly in accordance with certain embodiments.

In some embodiments the fluid in the container 40 is a cleaning fluid that may include additives that produce or enhance the production foam, functioning on application to pull debris away from the HVAC coils or other target object, allowing the debris to be removed simply by rinsing with water. One suitable fluid is Nu-Brite Condenser Coil Cleaning commercially available from Nu-Calgon. Typically the fluid is available in concentrated form, and may be diluted during spray application by a mixing chamber in a syphon gun assembly 45 that includes and attaches to or is integral to the cap 41. For example, the siphon gun assembly 45 (FIG. 7B) may include a conventional cap 41 that attaches to the container 40 housing the fluid cleaner, an internal mixing chamber, and a tube or the like in fluid communication with fluid cleaner in the container 40 volume. In some embodiments, the siphon gun assembly 45 includes an internal fluid passage (not shown) that in operation, allows delivery of a mixture of water and cleaning fluid into the applicator rod 10 upon actuation of the spray gun 46 coupled thereto.

More specifically, in certain embodiments the siphon gun assembly 45 is configured to receive, such as by a quick connect/disconnect coupling, a hand-held spray gun 46 that connects to a source of water such as through a hose. In some embodiments, the spray gun 46 may include a manual actuator such as a handle 47, which when actuated causes pressurized water to enter the siphon gun assembly 45. The siphon gun assembly 45 is also configured to receive, such as at an end 45' opposite the spray gun 46, the free end 23' of the main body region 23 of connector 20. Thus in some embodiments, the internal O-ring positioned in the region

25' of the internal bore 25 of the connector seals the connector to the cap 41 in a fluid-tight manner. Upon actuation of the spray gun 46, pressurized water enters the siphon gun assembly 45 which siphons the fluid cleaner in the container 40 through the internal passage of the siphon gun assembly 45, delivering a mixture of water and fluid cleaner to the applicator rod 10, where it is expelled from nozzle opening 14 and may be directed by the operator towards a target object.

What is claimed is:

1. A fluid spray assembly, comprising:

a. a container having a volume for containing a fluid to be sprayed, the container having an opening defined by a container neck, the opening being closable by a cap that secures to said container neck;

b. a siphon gun assembly including said cap, said siphon gun assembly having a fluid passage for delivery of fluid contained in said container and configured to coupe with a spray gun;

c. an applicator rod in fluid communication with said fluid passage via a hose;

d. a retaining bracket securing said hose to said siphon gun assembly, said retaining bracket having a first region comprising an opening configured to position about said container neck and a second region having an aperture configured to receive said connector; wherein said second region of said retaining bracket comprises first and second legs, said first leg connecting said first region to said second leg; and e. a connector coupling said hose to said siphon gun assembly, said connector comprises a male end segment that is received in said hose, and wherein said aperture of said second region is configured to receive said male end segment.

2. The fluid spray assembly of claim 1, wherein said second leg is oriented perpendicularly to said first region.

* * * * *